US007971280B2

(12) United States Patent
Kaneda

(10) Patent No.: US 7,971,280 B2
(45) Date of Patent: Jul. 5, 2011

(54) SOCKS

(75) Inventor: Masatoshi Kaneda, Koryo (JP)

(73) Assignee: Okamoto Corporation, Nara (JP)

( * ) Notice: Subject to any disclaimer, the term of this patent is extended or adjusted under 35 U.S.C. 154(b) by 484 days.

(21) Appl. No.: 11/794,913

(22) PCT Filed: Feb. 8, 2006

(86) PCT No.: PCT/JP2006/302121

§ 371 (c)(1),
(2), (4) Date: Aug. 22, 2007

(87) PCT Pub. No.: WO2007/091304

PCT Pub. Date: Aug. 16, 2007

(65) Prior Publication Data

US 2009/0282607 A1 Nov. 19, 2009

(51) Int. Cl.
*A43B 17/02* (2006.01)

(52) U.S. Cl. ..... 2/239

(58) Field of Classification Search ..... 2/239, 240, 2/241, 242, 409; 66/178 R, 179, 182, 183, 66/184, 185, 186, 187, 188, 178 A
See application file for complete search history.

(56) References Cited

U.S. PATENT DOCUMENTS

| | | | | | |
|---|---|---|---|---|---|
| 67,264 | A | * | 7/1867 | Carey | 66/187 |
| 1,216,374 | A | * | 2/1917 | Smith | 66/187 |
| 1,476,043 | A | * | 12/1923 | Bosworth | 66/179 |
| 1,544,934 | A | * | 7/1925 | Prankard | 66/188 |
| 1,936,038 | A | * | 11/1933 | Schindler | 66/185 |
| 1,974,993 | A | * | 9/1934 | Nebel | 66/185 |
| 2,018,248 | A | * | 10/1935 | Borner | 66/187 |
| 2,050,535 | A | * | 8/1936 | Martel | 66/178 R |
| 2,102,368 | A | * | 12/1937 | Martel | 66/182 |
| 2,165,520 | A | * | 7/1939 | Struve | 66/183 |
| 2,223,102 | A | * | 11/1940 | Grosse | 66/182 |
| 3,124,945 | A | * | 3/1964 | Moretta | 66/42 R |
| 3,298,205 | A | * | 1/1967 | Reymes-Cole | 66/185 |
| 4,341,097 | A | * | 7/1982 | Cassidy et al. | 66/187 |
| 4,522,044 | A | * | 6/1985 | Lineberry et al. | 66/185 |
| 4,898,007 | A | * | 2/1990 | Dahlgren | 66/185 |
| 5,103,656 | A | * | 4/1992 | Hanson, II | 66/185 |

(Continued)

FOREIGN PATENT DOCUMENTS

JP 6-22306 3/1994

(Continued)

OTHER PUBLICATIONS

Japanese Notice of Reasons for Rejection, with partial English translation, issued Aug. 3, 2010 in connection with corresponding Japanese Patent Application No. 2004-232064.

Japanese Notice of Reasons for Rejection issued Oct. 20, 2009 in the corresponding Japanese Patent Application No. 2004-232064 (with partial English translation).

(Continued)

*Primary Examiner* — Alissa L Hoey

(74) *Attorney, Agent, or Firm* — Wenderoth, Lind & Ponack, L.L.P.

(57) ABSTRACT

The present invention provides a comfortable sock free from tightness in a sole portion. The sock is constructed so that a bottom extension portion 13, in which the number of courses on the side of a sole portion 8 is larger than that on the side of an instep portion 9, is formed between a toe portion 5 and a heel portion 3, and length in the longitudinal direction of the sole portion 8 is larger than that of the instep portion 9.

20 Claims, 3 Drawing Sheets

U.S. PATENT DOCUMENTS

| | | | | |
|---|---|---|---|---|
| 5,412,957 | A * | 5/1995 | Bradberry et al. | 66/178 A |
| 5,603,232 | A * | 2/1997 | Throneburg | 66/185 |
| 5,617,745 | A * | 4/1997 | Della Corte et al. | 66/178 A |
| 5,771,495 | A * | 6/1998 | Turner et al. | 2/239 |
| 6,000,247 | A | 12/1999 | Takeda et al. | |
| 6,708,348 | B1 * | 3/2004 | Romay | 2/239 |
| 2004/0261466 | A1 | 12/2004 | Takeda et al. | |
| 2006/0218973 | A1 * | 10/2006 | Kim et al. | 66/178 R |
| 2008/0041113 | A1 * | 2/2008 | Mori et al. | 66/54 |
| 2009/0223254 | A1 * | 9/2009 | Ishida | 66/185 |
| 2009/0288451 | A1 * | 11/2009 | Yokoyama | 66/185 |

FOREIGN PATENT DOCUMENTS

| | | |
|---|---|---|
| JP | 2895473 | 3/1999 |
| JP | 3070670 | 5/2000 |
| JP | 2002-054004 | 2/2002 |
| JP | 2003-82501 | 3/2003 |
| JP | 2004-60081 | 2/2004 |
| JP | 2004-218131 | 8/2004 |
| JP | 3116261 | 12/2005 |

* cited by examiner

SOCKS

BACKGROUND OF THE INVENTION

1. Technical Field

The present invention relates to socks.

2. Background Art

Generally, a sock is formed by using a circular knitting machine typified by a hosiery circular knitting machine such as a model K hosiery machine, and a range from a leg portion to a toe portion of a sock is knitted in a tubular form. Consequently, the leg and toe portions become bilaterally symmetrical and each of the instep and sole sides also becomes symmetrical. Therefore, the dimensions of the toe portion are determined by using, as a reference, a first toe portion which projects the most in the toe.

When the toe portion is formed as described above, however, since the fifth toe is shorter and thinner than the first toe of a human, slackness occurs on the fifth toe side of the toe portion.

There are socks in which the number of wales is adjusted so that the toe portion fits the plan-view shape of the toe, and the number of courses on the first toe side is increased as compared with the other portion so that the toe portion has thicknesses according to the lengths of the toes (see Japanese Patent No. 2895473 and Utility Model Registration No. 3070670). The toe portion of a sock as described in Japanese Patent No. 2895473 has a shape fit to the toe, so that improved fitness of the toe portion is realized.

The sock described in Japanese Patent No. 2895473, however, has a problem. Since a leg portion is bilaterally symmetrical and, moreover, each of an instep side and a sole side has a symmetrical shape, when the toe is largely bent in the vertical direction such as when the user kicks the ground with his/her toes, the sole portion is pulled to the toe side by the thenar portion.

In particular, the entire toe portion of the sock as described in Japanese Patent No. 2895473 fits the toe, so that the sole portion is strongly pulled to the toe portion side by the whole thenar portion. Consequently, the sock as described in Japanese Patent No. 2895473 has a problem that tightness tends to occur in the sole portion and foot comfort is poor. Further, when the sole portion is tightened, the leg portion is pulled to the sole side through the heel portion, so that the sock tends to slide down. Since the sole portion is pulled to the toe side, there is another problem that the sock is susceptible to damage.

SUMMARY OF THE INVENTION

An object of the present invention is to provide comfortable socks free from tightening in the sole portion.

To solve the problem, the present invention provides a sock wherein a bottom extension portion, in which the number of courses on the side of a sole portion is larger than that on the side of an instep portion, is formed between a toe portion and a heel portion, and length in the longitudinal direction of the sole portion is larger than that of the instep portion.

With this arrangement, the bottom extension portion, in which the number of courses on the side of a sole portion is larger than that on the side of an instep portion, is formed between a toe portion and a heel portion, and length in the longitudinal direction of the sole portion is larger than that of the instep portion, so that allowance is provided in the sole portion. Consequently, even when the sole portion comes into contact with the thenar part, the sole portion is prevented from being pulled to the toe portion side because of the allowance in the sole portion, so that the sole portion is not tightened.

In this arrangement, it is also preferable to employ a configuration that a side extension portion in which the number of courses is increased in a portion between the first toe side of the sole portion and the instep portion side is formed between the toe portion and the heel portion. With this arrangement, the portion which comes into contact with the thenar in a sock is formed loosely more than the other portion. Thus, tightness on the thenar side of the sole portion is prevented more reliably.

Also in this arrangement, it is possible to employ a configuration in which the number of courses of the bottom extension portion is 20 to 30. The number of courses of the bottom extension portion is the value of the longest part of the bottom extension portion in the longitudinal direction.

Further in this arrangement, it is also preferable to employ a configuration in which the number of courses of the bottom extension portion is 66% to 87% of the number of courses forming a sole face of the heel portion. The number of courses of the bottom extension portion is the value of the longest part of the bottom extension portion in the longitudinal direction. The number of courses forming the sole face of the heel portion is the number of courses of the gore line portion forming the contour of the heel portion in bottom view. The number of courses of the bottom extension portion calculated from the number of courses forming the sole face of the heel portion and the above-described ratio is determined as a rounded value.

In the above-described arrangement, it is also preferable to employ a configuration in which the number of courses of the side extension portion is 10 to 14. The number of courses of the side extension portion is the value of the longest part of the side extension portion in the longitudinal direction.

As described above, with the arrangement of the present invention, the sole portion is prevented from being pulled to the toe side, so that comfortable socks without tightening in the sole portion at the time of walking or the like can be provided. Even when the toe portion is formed so as to fit the toe shape, the sole portion can be effectively prevented from being pulled. Thus, socks having excellent fit can be provided.

DETAILED DESCRIPTION OF THE INVENTION

Figure 1:
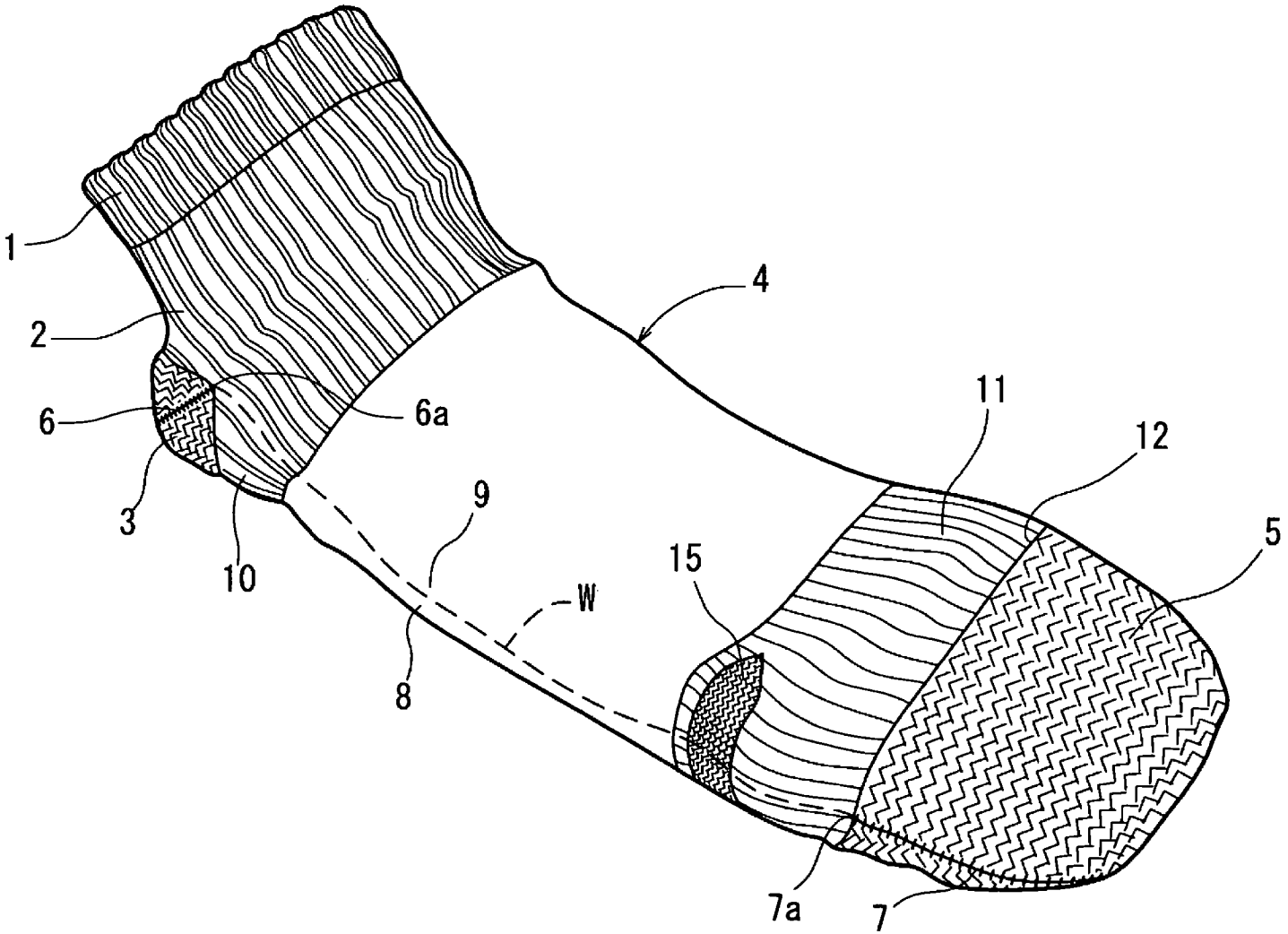
FIG. 1 is a general perspective view of a sock of an embodiment of the present invention.
Figure 2:
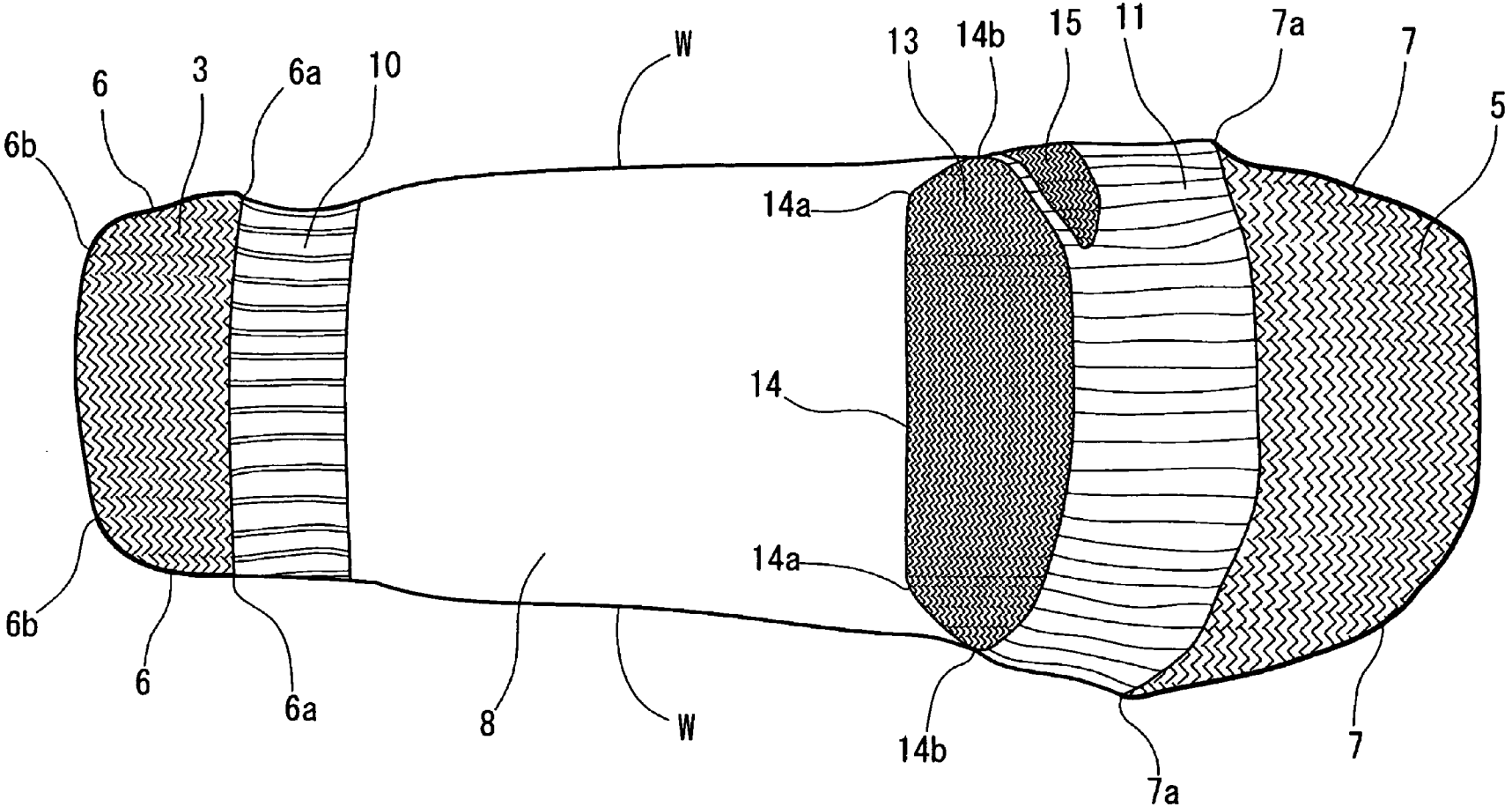
FIG. 2 is a bottom view of the sock.

Now the embodiment of the present invention is described with reference to FIGS. 1 to 3. As shown in FIGS. 1 and 2, the sock of the embodiment is formed with elastic yarn by using a hosiery circular knitting machine and has, in order from the opening side to the toe side, a rib top 1, a leg portion 2, a heel portion 3, a foot portion 4, and a toe portion 5.

The leg portion 2 is formed in a tubular shape at the lower end of the rib top 1, and the heel portion 3 is formed on the sole side of the leg portion 2 by forward/reverse half-turn movement or the like of the hosiery circular knitting machine. The foot portion 4 is provided in a tubular shape so as to be continued from the instep-side end of the leg portion 2 and the toe-side end of the heel portion 3. At the toe-side end of the foot portion 4, in a manner similar to the conventional technique, the toe portion 5 is formed so as to be fit to the toe shape.

When the heel portion 3 is formed, heel-side gore lines 6 are formed on both side thereof. When the toe portion 5 is formed, toe-side gore lines 7 are formed on both sides thereof. The heel-side gore lines 6 form the contour of the heel portion 3 in bottom view.

The foot portion 4 is a portion extending from the course connecting both the heel-side gore lines 6 and 6 to the course connecting both the toe-side gore lines 7 and 7. When a wale W connecting an instep-side end 6*a* of the heel-side gore line 6 to a heel-side end 7*a* of the toe-side gore line 7 is used as a border, the bottom-side portion in the foot portion 4 is a sole portion 8, and the instep-side portion of the foot portion 4 is an instep portion 9.

In the foot portion 4, to make the sock fit to the ankle portion, a fastening band 10 continued from the instep-side end of the leg portion 2 and the toe-side end of the heel portion 3 is formed with a width on the toe side by inserting rubber yarn in the course direction.

Further, a ring toe portion 11 continued from the heel-side end of the toe portion 5 is formed with a width on the heel side in the foot portion 4 by inserting reinforcement yarn in the course direction. The ring toe portion 11 is positioned between toes and the thenar portion B (refer to FIG. 3). The border between the toe portion 5 and the instep portion 9 is linking 12.

Figure 3:
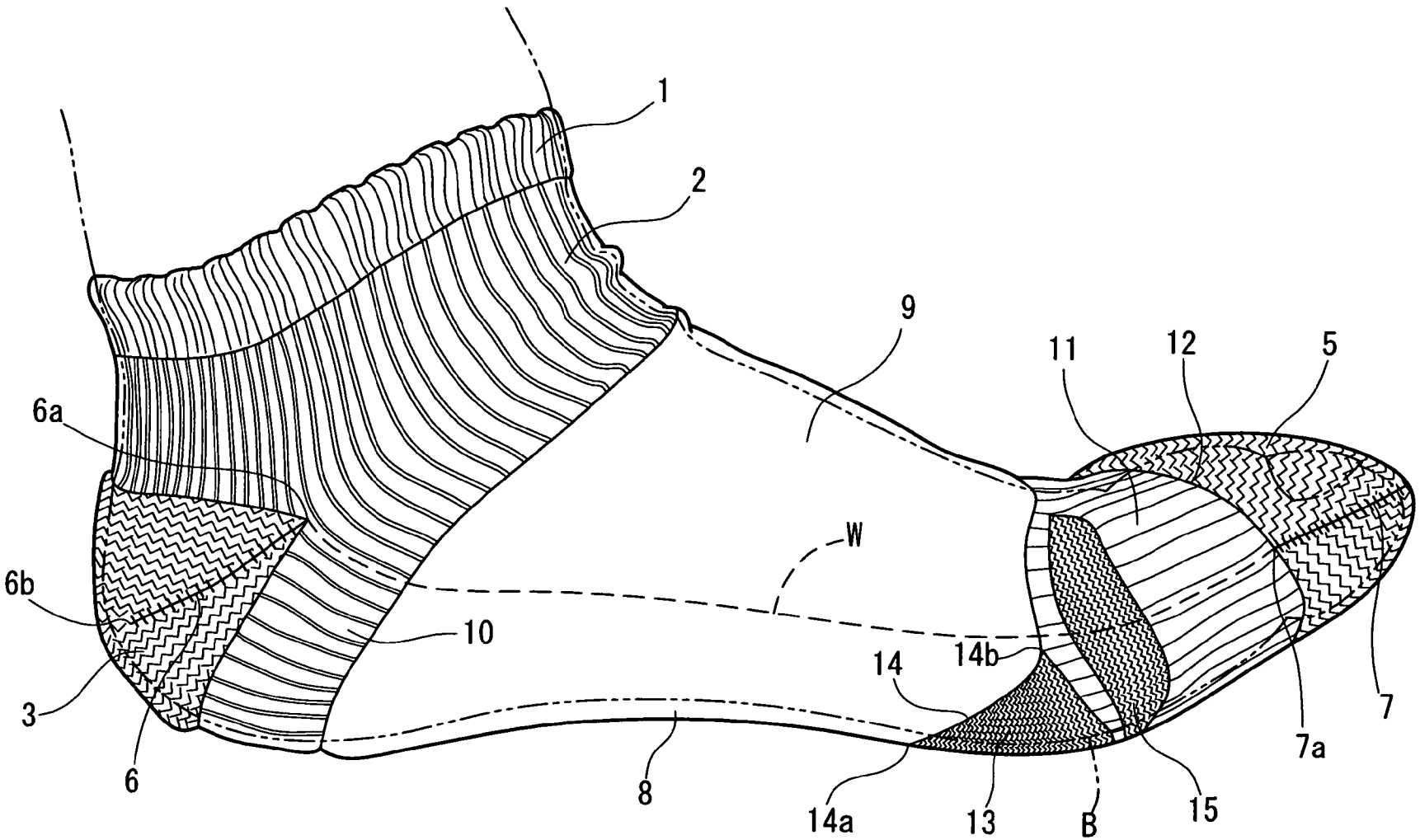
FIG. 3 is a side view showing a state of use of the sock from a first toe side.

As shown in FIGS. 2 and 3, between the heel portion 3 and the toe portion 5, a bottom extension portion 13, in which the number of courses on the sole portion 8 side is larger than that on the instep portion 9 side, is continuously formed at the heel-side end of the ring toe portion 11. The bottom extension portion 13 is provided with a width on the heel side from a portion in contact with the thenar portion B in the sole portion 8. With the formation of the bottom extension portion 13, the length in the longitudinal direction of the sole portion 8 is larger than that of the instep portion 9 only by an amount of the length of the bottom extension portion 13.

As the formation position of the bottom extension portion 13, it is sufficient to move the hosiery circular knitting machine by a forward/reverse half-turn to the heel side by about 18 to 36 courses from the course connecting the heel-side ends 7*a* and 7*a* of the toe-side gore lines 7 and 7 in accordance with the foot size. With the operation, the bottom extension portion 13 fits the thenar portion B.

In the bottom extension portion 13, forming lines 14 are formed on both sides. Heel-side ends 14*a* and 14*a* of the forming lines 14 and 14 are provided on the same wale or about the same wale as that of the instep-side ends 6*a* and 6*a* of the heel-side gore lines 6 and 6. Toe-side ends 14*b* and 14*b* of the forming lines 14 and 14 are provided on the same wale or about the same wale as that of sole-side ends 6*b* and 6*b* of the heel-side gore lines 6 and 6.

The forming lines 14 and 14 of the bottom extension portion 13 are provided so as to incline in the same direction as the heel-side gore lines 6 and 6 in bottom view. The numbers of courses between the bottom extension portion 13 and the heel portion 3 in the wales of the sole portion 8 are constant or almost constant.

By providing the forming lines 14 and 14 as described above, when the toe portion 5 is bent in the vertical direction, the sole portion 8 is expanded/contracted almost uniformly in the foot breadth direction. Consequently, tightening in the sole portion 8 is effectively prevented.

Although it depends on the foot size of a sock, usually, by setting the number of courses of the bottom extension portion 13 in a range from about 20 courses to 30 courses, tightening of the sole portion 8 is mostly eliminated. By the number of courses, the length in the longitudinal direction of the bottom extension portion 13 can be set to 1.5 cm to 3.0 cm. More preferably, the number of courses of the bottom extension portion 13 is set to 26 courses or less. When the number of courses exceeds 26, slackness tends to occur in the sole portion 8. The number of courses of the bottom extension portion 13 corresponds to the value of the longest portion of the bottom extension portion 13 in the length in the longitudinal direction and is, concretely, the number of courses from the course connecting both of the heel-side ends 14*a* and 14*a* to the course connecting both of the toe-side ends 14*b* and 14*b* of the forming lines 14.

Preferably, the number of courses of the bottom extension portion 13 is 66% to 87% of the number of courses of the sole face of the heel portion 3. When the number of courses of the bottom extension portion 13 is less than 66% of the number of courses of the sole face of the heel portion 3, tightening tends to occur in the toe portion 5. When the number of courses exceeds 87%, slackness tends to occur in the sole portion 8. The number of courses forming the sole face of the heel portion 3 corresponds to the number of courses of the heel-side gore line 6 forming the contour of the heel portion 3 in bottom view. Concretely, it corresponds to the number of courses from the course connecting the instep-side ends 6*a* and 6*a* of the heel-side gore lines 6 and 6 to the course connecting the sole-side ends 6*b* and 6*b*.

Further, a side extension portion 15 having a prolate ellipsoid shape in which the number of courses is increased from the first toe side of the sole portion 8 to the instep portion 9 is formed between the toe portion 5 and the heel portion 3 by a forward/reverse half-turn movement or the like of the hosiery circular knitting machine. The side extension portion 15 continues to the toe-side edge of the bottom extension portion 13 and is formed in a symmetrical shape using the wale W as the axis of symmetry.

The number of courses of the side extension portion 15 is preferably 10 to 14. Usually, with the number of courses, the length in the longitudinal direction of the side extension portion 15 ranges from 0.8 cm to 1.5 cm. When the number of courses of the side extension portion 15 is less than 10, tightening tends to occur on the first toe side of the sole portion 8. When the number of courses exceeds 14, slackness tends to occur on the first toe side of the sole portion 8. The number of courses of the side extension portion 15 corresponds to the value of the longest part of the side extension portion 15 in the length in the longitudinal direction and is, concretely, the number of courses on the wale W in the side extension portion 15.

Evaluations were made on the tightness of the sole portion 8 in the case of varying the number of courses of the bottom extension portion 13, knitting weave of the sole portion 8, and the presence/absence of the side extension portion 15 in the foregoing embodiment.

Evaluations of data are sensory evaluations in five levels of "slackened", "slightly slackened", "excellent", "slightly tightened", and "tightened" which are given after subjects walked on the same floor for five minutes. "Excellent" denotes that a subject does not feel slackness or tightness at all.

In samples 1 to 8, the number of courses forming the sole face of the heel portion 3 was fixed to 30 and the side extension portion 15 was not provided.

TABLE 1

| Sample | The number of courses of bottom extension portion | Knitting weave | The number of persons who make evaluations | Slackened | Slightly slackened | Excellent | Slightly tightened | Tightened |
|---|---|---|---|---|---|---|---|---|
| 1 | 12 | Pile weave | 5 | 0 | 0 | 0 | 2 | 3 |
| 2 | 12 | Plain weave | 5 | 0 | 0 | 0 | 2 | 3 |
| 3 | 19 | Pile weave | 5 | 0 | 0 | 0 | 4 | 1 |
| 4 | 20 | Pile weave | 5 | 0 | 0 | 3 | 2 | 0 |
| 5 | 22 | Pile weave | 6 | 0 | 0 | 4 | 2 | 0 |
| 6 | 26 | Pile weave | 5 | 0 | 3 | 2 | 0 | 0 |
| 7 | 30 | Pile weave | 5 | 1 | 4 | 0 | 0 | 0 |
| 8 | 31 | Pile weave | 5 | 5 | 0 | 0 | 0 | 0 |

As shown in Table 1, in the samples 1 and 2 in which the number of courses of the bottom extension portion 13 is 12 (about 1.5 cm), irrespective of the kind of the knitting weave of the sole portion 8, tightness of the sole portion 8 is not sufficiently eliminated. The case where the number of courses of the bottom extension portion 13 is 12 corresponds to 40% of the number of courses forming the sole face of the heel portion 3.

Also in the sample 3 in which the number of courses of the bottom extension portion 13 is 19, tightness still exists.

However, the sample 4 in which the number of courses of the bottom extension portion 13 is 20 (about 2.0 cm) is improved to an extent that obvious tightness does not exist and most of the subjects feel excellent. The case where the number of courses of the bottom extension portion 13 is 20 corresponds to 66% of the number of courses forming the sole face of the heel portion 3.

The sample 5 in which the number of courses of the bottom extension portion 13 is 22 (about 2.2 cm) is also improved like the sample 5. The case where the number of courses of the bottom extension portion 13 is 20 corresponds to 73% of the number of courses forming the sole face of the heel portion 3.

In the sample 6 in which the number of courses of the bottom extension portion 13 is 26 (about 2.6 cm), the tightness is completely eliminated, and the subjects felt excellent or slight slackness. The case where the number of courses of the bottom extension portion 13 is 26 corresponds to 87% of the number of courses forming the sole face of the heel portion 3.

However, in the sample 7 in which the number of courses of the bottom extension portion 13 is 30 (about 3.0 cm), although the tightness is completely eliminated, the tendency that the subjects felt slackness became stronger. The case where the number of courses of the bottom extension portion 13 is 30 corresponds to 100% of the number of courses forming the sole face of the heel portion 3.

Next, in the foregoing embodiment, the tightness of the sole portion 8 was evaluated by using the samples 9 and 10 in which the number of courses forming the sole face of the heel portion 3 is fixed to 30, the number of courses of the bottom extension portion 13 is 22, and the number of courses of the side extension portion 15 is 12 (about 1.0 cm). Table 2 shows the evaluation results.

TABLE 2

| Sample | The number of courses of bottom extension portion | Knitting weave | The number of persons who make evaluations | Slackened | Slightly slackened | Excellent | Slightly tightened | Tightened |
|---|---|---|---|---|---|---|---|---|
| 9 | 22 | Pile weave | 6 | 0 | 0 | 6 | 0 | 0 |
| 10 | 22 | Plain weave | 10 | 0 | 0 | 10 | 0 | 0 |

As obviously understood from the comparison between Table 2 and the sample 5 (having no side extension portion 15) in Table 1, although the samples 9 and 10 are different from each other with respect to the kinds of the knitting weaves of the sole portion 8, the tightness in the sole portion 8 is conspicuously eliminated in both of the samples 9 and 10. As described above, the side extension portion 15 is effective with respect to the point that tightness of the sole portion 8 can be eliminated while preventing slackness in the sole portion 8.

In the case of the samples 4 to 6, the stretch ratio of the first toe side including the toe portion 5 with respect to the fifth toe side is 85%. In contrast, the stretch ratio of the first toe side including the toe portion 5 with respect to the fifth toe side is 100%, and it was confirmed that the stretchability on the first toe side of the sole portion 8 is higher than that in the case of Table 1.

The evaluations in Tables 1 and 2 were made in the foot sizes of 25 cm to 27 cm. Similar evaluation results were obtained in all of the foot sizes.

The invention claimed is:

1. A sock comprising:

a heel portion at a longitudinally rear end portion of said sock, said heel portion having a first heel gore line formed as part of said heel portion on a first side of the sock and a second heel gore line formed as a part of said heel portion on a second side of the sock, said second side of said sock being opposite to said first side of said sock, said first and second heel gore lines having front ends, respectively, and dividing said heel portion into a heel instep portion and a heel sole portion;

a toe portion at a longitudinally front end of said sock, said toe portion having a first toe gore line formed as part of said toe portion on said first side of said sock and a second toe gore line formed as a part of said toe portion on said second side of said sock, said first and second toe gore lines having rear ends, respectively, and dividing said toe portion into a toe instep portion and a toe sole portion; and a foot portion defined between a first course that connects said front ends of said first and second heel gore lines and a second course that connects said rear ends of said first and second toe gore lines, said foot portion having a first wale connecting said front end of said first heel gore line to said rear end of said first toe gore line, and having a second wale connecting said front end of said second heel gore line to said rear end of said second toe gore line, said first and second wales dividing the foot portion into a foot instep portion and a foot sole portion, wherein said heel sole portion, said foot sole portion and said toe sole portion are disposed along the longitudinal direction of said sock such that said foot sole portion is disposed forward of said heel sole portion, and said toe sole portion is disposed forward of said foot sole portion, and such that said heel sole portion, said foot sole portion and said toe sole portion together constitute a sock sole portion, wherein a bottom extension portion is connected as an insert in an area of said foot sole portion spaced apart by 18 to 36 courses from said second course in a direction toward said heel portion, and said bottom extension portion is configured such that a length of said sock from said rear side of said foot sole portion to said toe sole portion is longer than a length of said sock from a rear side of said foot instep portion to said toe instep portion, wherein a ring toe portion is connected to a rear side of said toe portion, said ring toe portion being formed by inserting reinforcement yarn, wherein a front side of said bottom extension portion is connected to a rear side of said ring toe portion and does not extend onto said sock instep portion, wherein a side extension portion is provided as an insert between said toe portion and said heel portion, and said side extension is configured such that a length of said sock on a first toe side is greater than a length of said sock on a fifth toe side, and wherein said side extension portion extends from said sock sole portion to said sock instep portion.

2. The sock according to claim 1, wherein said side extension portion has a number of courses, in a longitudinal direction of said sock that increases in a portion between a first toe side of said sole portion and an instep portion side.

3. The sock according to claim 2, wherein said side extension portion has 10 to 14 courses.

4. The sock according to claim 2, wherein a predetermined number of courses of said bottom extension portion is 20 to 30.

5. The sock according to claim 2, wherein a predetermined number of courses of said bottom extension portion is 66% to 87% of a number of courses forming a sole face of said heel portion.

6. The sock according to claim 1, wherein a predetermined number of courses of said bottom extension portion is 20 to 30.

7. The sock according to claim 6, wherein a predetermined number of courses of said bottom extension portion is 66% to 87% of a number of courses forming a sole face of said heel portion.

8. The sock according claim 1, wherein a predetermined number of courses of said bottom extension portion is 66% to 87% of a number of courses forming a sole face of said heel portion.

9. The sock according claim 1, further comprising a tubular leg portion, wherein said heel portion is connected to said tubular leg portion, wherein said foot instep portion is connected to said leg portion along said first course, wherein said foot sole portion is connected to said heel sole portion, and wherein the length of said sock from said rear side of said foot sole portion to said toe sole portion is longer than a length of said sock from said rear side of said foot instep portion to said toe instep portion by an amount equal to a length of said bottom extension portion.

10. The sock according claim 1, wherein said bottom extension portion extends over a thenar portion of the foot where the toes meet the sole of the foot.

11. The sock according claim 1, wherein said bottom extension portion does not extend onto said sock instep portion.

12. The sock according to claim 1, wherein said side extension portion is spaced apart from said bottom extension portion.

13. The sock according to claim 1, wherein said side extension portion has 10 to 14 courses.

14. A sock comprising:

a heel portion at a longitudinally rear end portion of said sock, said heel portion having a first heel gore line formed as part of said heel portion on a first side of the sock and a second heel gore line formed as a part of said heel portion on a second side of the sock, said second side of said sock being opposite to said first side of said sock, said first and second heel gore lines having front ends, respectively, and dividing said heel portion into a heel instep portion and a heel sole portion;

a toe portion at a longitudinally front end of said sock, said toe portion having a first toe gore line formed as part of said toe portion on said first side of said sock and a second toe gore line formed as a part of said toe portion on said second side of said sock, said first and second toe gore lines having rear ends, respectively, and dividing said toe portion into a toe instep portion and a toe sole portion; and a foot portion defined between a first course that connects said front ends of said first and second heel gore lines and a second course that connects said rear ends of said first and second toe gore lines, said foot portion having a first wale connecting said front end of said first heel gore line to said rear end of said first toe gore line, and having a second wale connecting said front end of said second heel gore line to said rear end of said second toe gore line, said first and second wales dividing the foot portion into a foot instep portion and a foot sole portion, wherein said heel sole portion, said foot sole portion and said toe sole portion are disposed along the longitudinal direction of said sock such that said foot sole portion is disposed forward of said heel sole portion, and said toe sole portion is disposed forward of said foot sole portion, and such that said heel sole portion, said foot sole portion and said toe sole portion together constitute a sock sole portion, wherein a bottom extension portion is connected as an insert in an area of said foot sole portion spaced apart by 18 to 36 courses from said second course in a direction toward said heel portion, and said bottom extension portion is configured such that a length of said sock from said rear side of said foot sole portion to said toe sole portion is longer than a length of said sock from a rear side of said foot instep portion to said toe instep portion, wherein a ring toe portion is connected to a rear side of said toe portion, said ring toe portion being formed by inserting reinforcement yarn, wherein a front side of said bottom extension portion is connected to a rear side of said ring toe portion and does not extend onto said sock instep portion, wherein a side extension portion is provided as an insert in said ring toe portion, and said side extension is configured such that a length of said sock on a first toe side is greater than a length of said sock on a fifth toe side, and wherein said side extension portion extends from said sock sole portion to said sock instep portion.

15. The sock according to claim 14, wherein said side extension portion has 10 to 14 courses.

16. The sock according to claim 15, wherein a predetermined number of courses of said bottom extension portion is 20 to 30.

17. The sock according to claim 16, wherein a predetermined number of courses of said bottom extension portion is 66% to 87% of a number of courses forming a sole face of said heel portion.

18. The sock according claim 15, wherein a predetermined number of courses of said bottom extension portion is 66% to 87% of a number of courses forming a sole face of said heel portion.

19. The sock according claim 15, further comprising a tubular leg portion, wherein said heel portion is connected to said tubular leg portion, wherein said foot instep portion is connected to said leg portion along said first course, wherein said foot sole portion is connected to said heel sole portion, and wherein the length of said sock from said rear side of said foot sole portion to said toe sole portion is longer than a length of said sock from said rear side of said foot instep portion to said toe instep portion by an amount equal to a length of said bottom extension portion.

20. The sock according claim 15, wherein said bottom extension portion does not extend onto said sock instep portion.

* * * * *